US009523946B2

(12) United States Patent
Dedic

(10) Patent No.: US 9,523,946 B2
(45) Date of Patent: Dec. 20, 2016

(54) METHOD AND DEVICE FOR DIGITAL PRINTING TO A RECORDING MEDIUM WITH LIQUID INK

(71) Applicant: Oce Printing Systems GmbH & Co. KG, Poing (DE)

(72) Inventor: Revdin Dedic, Markt Schwaben (DE)

(73) Assignee: Océ Printing Systems GmbH & Co. KG, Poing (DE)

( * ) Notice: Subject to any disclaimer, the term of this patent is extended or adjusted under 35 U.S.C. 154(b) by 0 days.

(21) Appl. No.: 15/046,968

(22) Filed: Feb. 18, 2016

(65) Prior Publication Data

US 2016/0246221 A1 Aug. 25, 2016

(30) Foreign Application Priority Data

Feb. 19, 2015 (DE) ..... 10 2015 017 058
Feb. 19, 2015 (DE) ..... 10 2015 102 341

(51) Int. Cl.
*G03G 15/20* (2006.01)

(52) U.S. Cl.
CPC ..... *G03G 15/2014* (2013.01); *G03G 15/2017* (2013.01); *G03G 15/2021* (2013.01)

(58) Field of Classification Search
CPC ..... G03G 15/2014; G03G 15/2017; G03G 15/2021
See application file for complete search history.

(56) References Cited

U.S. PATENT DOCUMENTS

| | | | | |
|---|---|---|---|---|
| 8,509,656 | B2 | 8/2013 | Kopp | |
| 8,737,885 | B1 | 5/2014 | Berg | |
| 8,849,171 | B2 | 9/2014 | Dedic et al. | |
| 8,958,716 | B2 * | 2/2015 | Saito | G03G 15/2021 399/92 |
| 2013/0121739 | A1 * | 5/2013 | Hatazaki | G03G 15/2021 399/341 |

FOREIGN PATENT DOCUMENTS

| | | | |
|---|---|---|---|
| DE | 102006012940 | B3 | 9/2007 |
| DE | 102008048256 | A1 | 4/2010 |
| DE | 102009060334 | A1 | 6/2011 |
| DE | 102010015985 | A1 | 9/2011 |
| DE | 102010017239 | A1 | 12/2011 |
| DE | 202012111791 | A1 | 6/2014 |
| EP | 1155844 | A2 | 11/2001 |

* cited by examiner

*Primary Examiner* — Hoang Ngo
(74) *Attorney, Agent, or Firm* — Schiff Hardin LLP

(57) ABSTRACT

A method and device for digital printing to a recording medium with liquid print color is described. In a method for digital printing, a print image defined by print data is printed onto the recording medium via application of the liquid print color. After the application of the liquid print color onto the recording medium, the recording medium can be heated to vaporize the carrier fluid. Upon heating, air is supplied that mixes with the vapor to form a combustible gas. The combustible gas can be supplied to a combustion chamber and converted into waste gas. In a method for digital printing, an areal coverage can be determined. The areal coverage describes a quantity of color applied onto the recording medium by the carrier fluid. Further, the air supply can be proportionally controlled to the determined areal coverage.

16 Claims, 3 Drawing Sheets

METHOD AND DEVICE FOR DIGITAL PRINTING TO A RECORDING MEDIUM WITH LIQUID INK

CROSS REFERENCE TO RELATED APPLICATIONS

This patent application claims priority to German Patent Application No. 102015102341.5, filed Feb. 19, 2015, and German Patent Application No. 102015017058.9, filed Jan. 15, 2016, which is a divisional of German Patent Application No. 102015102341.5, each of which is incorporated herein by reference in its entirety.

BACKGROUND

The present disclosure concerns a method and a device for digital printing to a recording medium with liquid ink.

In digital printing, both liquid toner and liquid colors are used as ink.

Devices for digital printing to a recording medium with liquid toner are liquid toner printing apparatuses, in which toner particles are applied to the recording medium to be printed to with the aid of a liquid toner. Such devices are known from DE 10 2010 015 985 A1, DE 10 2008 048 256 A1, DE 10 2009 060 334 A1 or DE 10 2012 111 791 A1. For this, a latent charge image of a charge image carrier is inked by means of electrophoresis with the aid of a liquid toner. The toner image created in such a manner is transferred to the recording medium indirectly (via a transfer element) or directly. The liquid toner has toner particles and carrier fluid in a desired ratio. The toner particles are suspended in the carrier fluid. This allows the use of small toner particles with a diameter of less than 8 μm, for example. If such small particles are handled as powder, they pose a health hazard. In contrast to this, if they are suspended in a carrier fluid, no health hazard exists. The use of such small toner particles on the one hand allows a print image with very high resolution since the toner particles are smaller than given conventional electrophoretic printing methods in which no carrier fluid is used. Furthermore, the layer thickness of the toner particles on the recording medium is less. This is advantageous in particular when multiple colors are printed atop one another. The toner particles incur the greatest costs in the printing process. The smaller the printed toner quantity, the lower the costs as well.

Mineral oil can be used as carrier fluid. In order to provide the toner particles with an electrostatic charge, charge control substances are added to the liquid developer. Further additives may additionally be added, for example in order to achieve the desired viscosity or a desired drying behavior of the liquid developer.

The toner particles are comprised of wax and color particles. In the fixing process, the recording medium with the applied toner particles is heated, whereby the carrier fluid is vaporized. The toner particles are hereby also heated and thermoplastically deformed. The particles flow into one another and bind to the recording medium. The heating of the recording medium thus simultaneously serves to fix the toner particles onto the recording medium and to dry the recording medium.

The carrier fluid vaporized in the fixing station mixes with air and thus forms a flammable gas, is designated in the following as "combustible gas". This combustible gas is supplied to a combustion chamber and burned there. Via the burning of the combustible gas, a waste gas is generated that is not flammable and in which toxic components of the combustible gas are converted into non-toxic components. The combustible gas is heated and the waste gas is cooled with a heat exchanger. If a heat exchanger with high efficiency is used, a bypass line for the waste gas is then provided with which a portion of the waste gas is supplied past the heat exchanger to a chimney. Given fluctuations in the input of the carrier fluid into the combustible gas, in the short term a large quantity of heat may hereby be removed from the system as a whole since the regulation of the air supply for the combustible gas is too slow in order to be adapted to a rapidly changing vapor quantity of carrier fluid.

If a heat exchanger with low efficiency is used, it is then in fact possible to direct a large quantity of hot waste gas through the heat exchanger. In order to be able to compensate for fluctuations in the input of the carrier fluid, given such a device the burner is in principle operated with a high proportion of fuel that may be reduced given a short-term increase in carrier fluid vapor or increased again given a decrease in carrier fluid vapor. The vapor quantity is thus compensated by varying the supply of fuel. In this embodiment, the fuel consumption is significantly greater than given the embodiment with the bypass line as explained above.

The bypass line may be opened and closed quickly with corresponding valves. Since the uncooled waste gas is supplied to the bypass line, it must be designed for correspondingly high temperatures. This also applies to the valves. This is technically complicated and generates correspondingly high costs.

In offset printing, solvents are vaporized in a fixing station, which solvents—with supplied air—form a combustible gas and are similarly thermally heated in a combustion chamber. However, in offset printing a specific print image is often printed successively, such that the entry of solvent is essentially constant. In offset printing, there is hereby not the problem of varying composition of the combustible gas.

In offset printing, only the solvent is dried off from applied color particles, but these are not thermoplastically deformed. A print image generated in digital printing with the liquid toner explained above is significantly more stable than a print image generated in offset printing since the digital print image generated by means of liquid toner can no longer be dissolved due to the thermoplastic deformation.

It is also known that ink may have a flammable solvent or also a mineral oil that must be prepared in the printing process, similar to the carrier fluid explained above.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
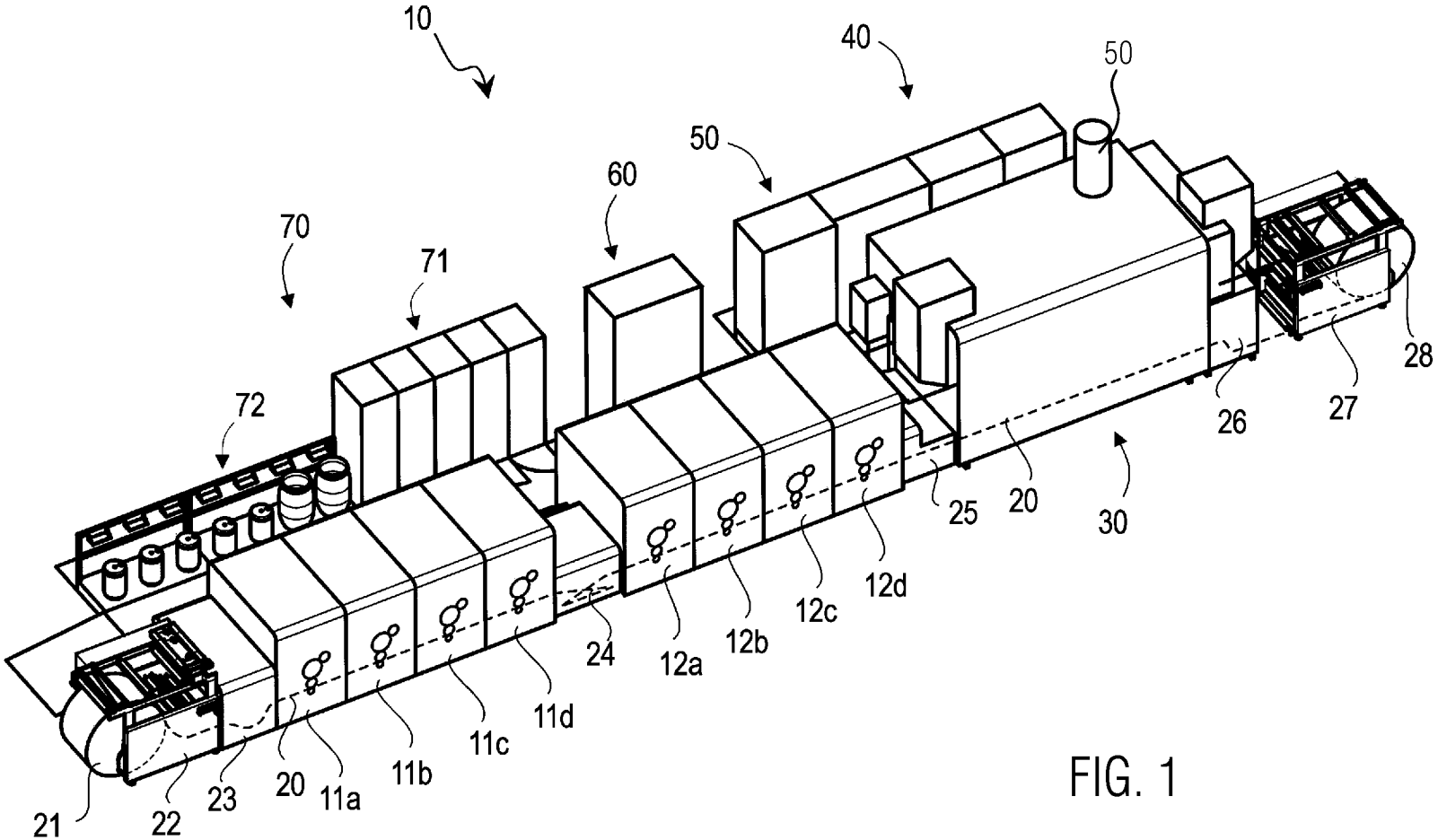
FIG. 1 is a perspective view of a liquid toner printing apparatus according to an exemplary embodiment.

The exemplary embodiments of the present disclosure will be described with reference to the accompanying drawings.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

The disclosure describes methods and devices for digital printing to a recording medium with liquid print color, with which method and device the combustible gas made up of air and the vapor of the carrier fluid may be simply and efficiently thermally prepared A method according to an exemplary embodiment includes, for digital printing to a recording medium with liquid print color that comprises pigment comprised in a flammable carrier fluid, a print image defined by print data is printed onto the recording medium via application of the liquid print color, and after the application of the liquid print color the recording medium is heated to evaporate the liquid print color. Upon heating, air is supplied which mixes with the vapor to form a combustible gas, which is supplied to a combustion chamber in which it is burned to form waste gas. In an exemplary embodiment, an areal coverage is determined that describes the quantity of color applied onto the recording medium by means of the carrier fluid, wherein the air supply is controlled proportional to the areal coverage. The areal coverage is determined using the print data that describe the print image. Since the print data are in principle already known before the printing process in which the liquid print color is applied onto the recording medium, the areal coverage may already be determined before the printing process. Therefore, it is known at an early stage how much carrier fluid is transferred onto the recording medium by the printing process and is introduced into a heating chamber in which the recording medium is heated to fix the pigment and to vaporize the carrier fluid. Air is supplied to the heating chamber by means of a blower, wherein the reaction time is known that is present between changing a control signal for the blower and the corresponding change to the supplied quantity of air. Since the areal coverage is already known before the printing process, the blower may be activated such that the supplied quantity of air is always proportional to the carrier fluid introduced into the heating chamber. The proportion of vaporized carrier fluid in combustible gas may hereby be kept approximately constant. This has the consequence that—even given a use of a heat exchanger with high efficiency—no bypass line is necessary since, given a large amount of introduced carrier fluid, a correspondingly large amount of air is supplied, such that the entire volume flow changes accordingly, whereby in the combustion chamber it is not the temperature of the waste gas but rather the quantity of waste gas that increases or decreases. It is hereby unnecessary to divert hot waste gas directly past the heat exchanger; rather, the waste gas may always be directed across the heat exchanger.

The changes at the entry of the carrier fluid into the heating chamber are thus not compensated via a bypass line or a change to the fuel supply, but rather via an early change to the air supply into the heating chamber. This is significantly simpler and more efficiency since the consumption of fuel is low and no bypass line is necessary. In addition to this, the waste gas temperature may be kept lower than given a device with bypass line, whereby the thermal requirements for the materials (in particular steels) bounding the combustion chamber, the heat exchanger and a chimney are significantly lower. Steels that are not heated over 850° C. are significantly more cost-effective than steels that are thermally stable up to temperatures of 1,000° C.

In an exemplary embodiment, a waste gas return feed is provided to return a portion of the waste gas from the combustion chamber to the heating chamber. With the waste gas return feed, the heat that is contained in the waste gas is supplied to the heating chamber. Furthermore, via a waste gas return feed the proportion of toxic waste gases (in particular of carbon monoxide) in the waste gases discharged to the environment may be reduced.

Fuel may be supplied into the combustion chamber as needed. This primarily serves to keep the combustion process stable given very small quantities of introduced carrier fluid, and to keep the temperature of the waste gas in the combustion chamber at a specified minimum temperature. In an exemplary embodiment, the minimum temperature should be at least 700° C. or 750° C., in particular 760° C. In an exemplary embodiment, the minimum temperature is at least 765° C., in order to ensure that the combustible portions in the combustible gas are nearly completely burned.

In an exemplary embodiment, the supplied quantity of fuel is controlled such that the combustion temperature is less than or equal to a predetermined maximum temperature. In an exemplary embodiment, the maximum temperature is 900° C. or 870° C., in particular 850° C. In an exemplary embodiment, the maximum temperature is 845° C. The lower the maximum temperature, the lower as well the requirements for the materials that bound the combustion chamber and all additional modules through which the waste gas is directed.

Given a longer combustion chamber, the minimum temperature and the maximum temperature to satisfy the necessary waste gas values may be adjusted to be lower than given a shorter combustion chamber.

In an exemplary embodiment, a device for digital printing to a recording medium with liquid print color that includes a carrier fluid having a pigment, with using the device, a print image defined by print data is printed onto the recording medium via application of the carrier fluid, the device comprising:

- a heating chamber configured to heat the recording medium, after application of the liquid print color onto said recording medium, to vaporize the carrier fluid,
- a blower configured to supply air to the heating chamber, the air mixing with the vapor to form a combustible gas, and
- a combustion chamber configured to burn the combustible gas to form waste gas.

In an exemplary embodiment, the device includes a controller configured to determine an areal coverage that describes the quantity of color applied onto the recording medium by the liquid print color, wherein the controller controls the air supply proportionally to the areal coverage.

An exemplary embodiment of a digital printing system that comprises a digital printer 10 is shown in FIG. 1.

According to FIG. 1, the digital printer 10 for printing to a recording medium 20 has one or more print groups 11*a*-11*d* and 12*a*-12*d* that print a toner image (print image) onto the recording medium 20. As shown, a web-shaped recording medium 20 as a recording medium 20 is unspooled from a roll 21 with the aid of a take-off 22 and is supplied to the first print group 11*a*. The print image is fixed on the recording medium 20 in a fixer 30. The recording medium 20 may subsequently be taken up on a roll 28 with the aid of a take-up 27. Such a configuration is also designated as a roll-to-roll printer.

In an exemplary embodiment, as illustrated in FIG. 1, the web-shaped recording medium 20 is printed to in full color on the front side with four print groups 11*a* through 11*d* and on the back side with four print groups 12*a* through 12*d* (what is known as a 4/4 configuration). For this, the recording medium 20 is unspooled from the roll 21 by the take-off 22 and supplied to the first print group 11*a* via an optional conditioning group 23. In the conditioning group 23, the recording medium 20 may be pre-treated or coated with a suitable substance. In an exemplary embodiment, wax, or chemically equivalent substances, may be used as a coating substance (also designated as a primer).

This substance may be applied over the entire surface, or only to the points of the recording medium 20 that are to be printed to later, in order to prepare the recording medium 20 for printing and/or to affect the absorption behavior of the recording medium 20 upon application of the print image. With this it is prevented that the toner particles or carrier fluid that are applied later do not penetrate too deeply into the recording medium 20, but rather remain essentially on the surface (color quality and image quality are thereby improved).

The recording medium 20 is subsequently supplied first, in order, to the first print groups 11*a* through 11*d* in which only the front side is printed to. Each print group 11*a*-11*d* typically prints to the recording medium 20 in a different color or also with different toner material, for example MICR toner which can be read electromagnetically.

After printing to the front side, the recording medium 20 may be turned in a turner 24 and be supplied to the remaining print groups 12*a*-12*d* for printing to the back side. In the region of the turner 24, an additional conditioning group (not shown) may optionally be arranged via which the recording medium 20 is prepared for the printing to the back side, for example a fixing (partial fixing) or other conditioning of the previously printed front side print image (or of the entire front side, or also the back side). It is thus prevented that the front-side print image is mechanically damaged upon further transport through the subsequent print groups.

In order to achieve a full-color printing, at least four colors (and therefore at least four print groups 11, 12) are required, and in fact the primary colors YMCK (Yellow, Magenta, Cyan and Black), for example. Still more print groups 11, 12 with special colors (for example customer-specific colors or additional primary colors in order to expand the printable color space) may also be used.

Arranged after the print group 12*d* is a register 25 via which registration marks—which are printed on the recording medium 20 independently of the print image (in particular outside of the print image)—are evaluated. The transversal and longitudinal registration (the primary color dots that form a color point should be arranged atop one another or spatially very close to one another; this is also designated as color registration or four-color registration) and the register (front side and back side must spatially coincide precisely) can therefore be adjusted so that a qualitatively good print image is achieved.

Arranged after the register 25 is the fixer 30 via which the print image is fixed on the recording medium 20. In an exemplary embodiment, given electrophoretic digital printers, a thermal dryer as fixer 30 is used that largely vaporizes the carrier fluid so that only the toner particles still remain on the recording medium 20. The toner particles may thereby also be fused onto the recording medium 20 insofar as they comprise a material (resin, for example) that can melt as a result of the effect of heat. The fixer is explained in further detail below.

Arranged after the fixer 30 is a puller 26 that pulls the recording medium 20 through all print groups 11*a*-12*d* and the fixer 30, without an additional drive being arranged in this region. The danger that the as of yet unfixed print image could be smeared would exist due to a friction drive for the recording medium 20.

The puller 26 feeds the recording medium 20 to the take-up 27, which rolls up the printed recording medium 20.

Centrally arranged in the print groups 11, 12 and the fixer 30 are all supply devices for the digital printer 10, such as air-conditioning modules 60, power supply 61, controller 2 (controller), fluid management modules 70 (such as fluid controller 71 and reservoirs 72 of the different fluids). In particular, pure carrier fluid, highly-concentrated liquid toner (high proportion of toner particles in relation to carrier fluid) and serum (liquid toner plus charge control substances) are required as fluids in order to supply the digital printer 10, as well as waste containers for fluids to be disposed of or containers for cleaning fluid.

The digital printer 10, with its structurally identical print groups 11, 12, is of modular design. The print groups 11, 12 do not differ mechanically, but rather only due to the liquid toner (toner color or toner type) used therein.

Such a print group 11, 12 is based on the electrophotographic principle, in which a photoelectric image carrier is inked with charged toner particles with the aid of a liquid toner, and the image that is created in such a manner is transferred to the recording medium 20.

The print group 11, 12 is essentially comprised of an electrophotography station, a developer station and a transfer station.

Figure 2:
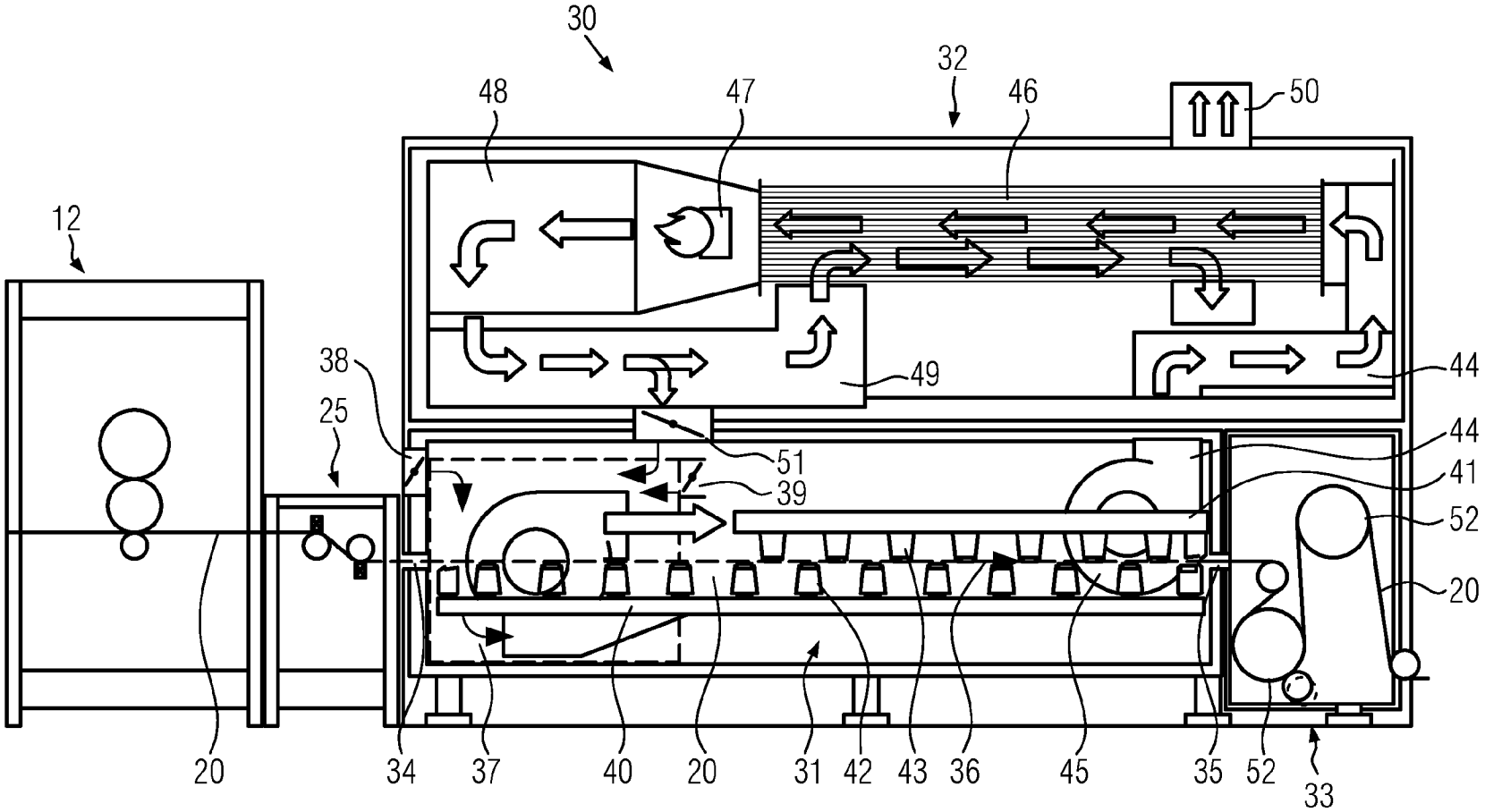
FIG. 2 is a fixing station according to an exemplary embodiment of the liquid toner printing apparatus from FIG. 1.

The fixer 30 comprises a heating chamber 31 (FIG. 2) in which the recording medium 20 is heated in order to fix the toner particles and vaporize the carrier fluid, as well as a thermal cleaning system 32 in order to thermally prepare combustible gas created in the heating chamber 31. Furthermore, a belt cooler 33 is provided in the fixer 30 in order to again cool the recording medium 20 heated in the heating chamber 31. The heating chamber 31 has a slot-shaped inlet 34 and a slot-shaped outlet 35 through which the web-shaped recording medium 20 is supplied to or discharged from the heating chamber 31. Within the heating chamber 31, the recording medium 20 is moved in the transport direction 36 along a horizontal conveyor path. Adjacent to the inlet 34, a heating fan 37 is provided to the side of the heating chamber 31. The heating blower 27 comprises a blower and a heater. The heating fan 37 has two air inlets: a fresh air inlet 38 and a circulation air inlet 39. Both air inlets 38, 39 are openings in the heating blower 37 that may respectively be opened and closed via a flap. The fresh air inlet 38 is an opening in the heating blower 37 that leads to the outside (relative to the heating chamber 31) so that fresh ambient air may be drawn in through this. The circulation air inlet 39 is an opening in the heating blower that leads further into the inner region of the heating chamber 31, such that air may hereby be drawn out of the heating chamber and be re-dispensed into the heating chamber.

Arranged above and below the transport path of the recording medium 20 are air channels 40, 41 which have nozzles 42, 43 which are aligned with the openings for the transport path of the recording medium 20. The air channels 40, 41 are arranged so that they accept the heated air supplied from the heating blower 37 and direct this via their nozzles 42, 43 in the direction of the recording medium. The temperature of this hot air output from the heating blower 37 typically amounts to approximately 180° C. to 300° C.

The hot air supplied via the nozzles 42, 43 heats the recording medium such that the toner particles located thereupon are thermoplastically deformed and fixed on the recording medium 20. At the same time, the carrier fluid applied onto the recording medium 20 vaporizes. The carrier fluid is a flammable liquid, in particular mineral oil. The vapor of the carrier fluid mixes with the hot air to form a flammable gas that is designated as "combustible gas" in the following.

An escape line 44 leads from the heating chamber 31 to the thermal cleaning systems 32. In the escape line 44, an escape blower 45 is provided with which a defined quantity of combustible gas may be drawn out of the heating chamber 31 and supplied to the thermal cleaning system 32. The escape line 44 opens into a heat exchanger 46. The combustible gas is supplied via the heat exchanger 46 to a burner 47 that is located within a combustion chamber 48. The burner 47 is connected with a fuel line (not shown) via which additional fuel may be supplied. In an exemplary embodiment, gaseous fuel—in particular natural gas—is used here as a fuel.

In the combustion chamber 48, the combustible gas is burned to form exhaust air. An exhaust channel 49 leads from the combustion chamber to the heat exchanger 46, in which the exhaust air is directed in a counterflow relative to the combustible gas. The exhaust air is hereby cooled via the heat exchange with the combustible gas. The counterflow line of the heat exchanger 46 opens into a chimney 50 through which the exhaust air is discharged to the environment.

The exhaust air channel is connected via an opening 51 with the heating chamber 31. In the opening 51, a flap to close and open the opening 51 is provided so that a defined quantity of exhaust air may be directed back into the heating chamber 31. Via the return of a portion of the exhaust air into the heating chamber, energy is on the one hand supplied to said heating chamber, and on the other hand the emissions values may be improved via the recirculation of the exhaust air.

The belt cooler 33 has multiple rollers 52 around which the belt-shaped recording medium is directed. At least one of the rollers 52 is cooled so that the recording medium 20 is cooled after the heating in the heating chamber 31.

In the following, the operation of the printing system according to the disclosure with the fixing station 30 explained above is explained in detail.

The recording medium 20 is directed through the heating chamber 31 in the transport direction 36 at a predetermined production velocity (for example 1 m/s to 3 m/s). The recording medium is normally comprised of paper and is heated to a temperature of at least 120° C. by means of the hot air supplied via the nozzles 42, 43. Depending on the type and quality of the recording medium, temperatures of 120° C. to 300° C. are appropriate here.

The combustible gas (which comprises air and the vapor of the carrier fluid) which is hereby created is supplied via the exhaust line 44 from the heating chamber 31 to the heat exchanger 46 of the thermal cleaning system 32. IN the heat exchanger 46, the combustible gas is heated to a temperature of approximately 450° C. and supplied to the burner 47. In the combustion chamber 48, the combustible gas is converted into waste gas by burning it. Given a low proportion of carrier fluid vapor or given a small quantity of combustible gas, fuel may hereby be additionally supplied to the burner 47 in order to ensure a stable combustion. The waste gas that is hereby generated has a temperature of approximately 750° C. to 850° C. In an exemplary embodiment, the burning process is regulated such that the temperature of the waste gas is in a range from 760° C. to 770° C., and in particular is 765°. In an exemplary embodiment, a minimum temperature of approximately 750° C., and in particular of 760° C., is appropriate since a complete combustion of the flammable parts of the combustible gas is hereby ensured, and the proportion of carbon monoxide may be kept low.

The hot waste gas is supplied via the escape line 49 to the heat exchanger 46 and flows through this in a counterflow relative to the combustible gas. The temperature of the waste gas is hereby reduced to approximately 450° C. This cooled waste gas may be output to the environment via the chimney 50.

Figure 3:
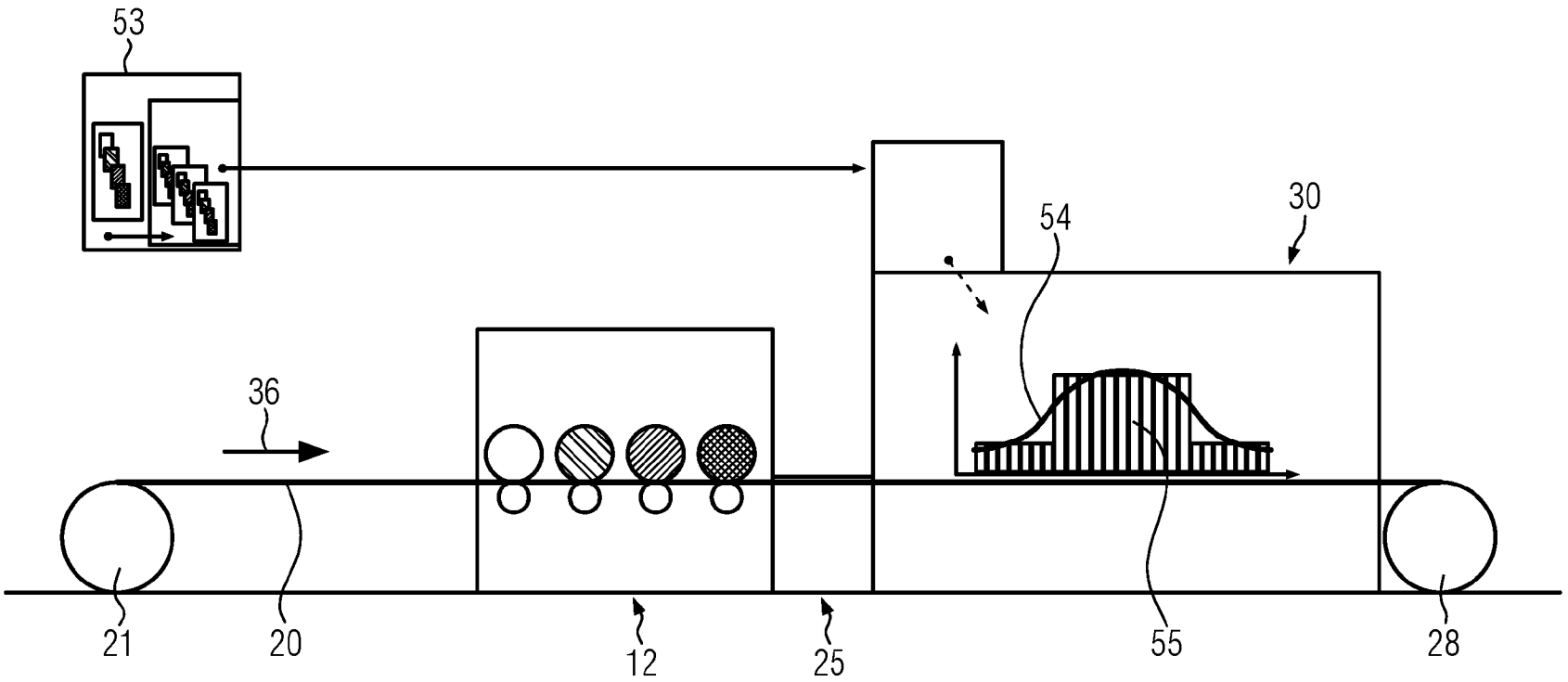
FIG. 3 is a block diagram illustrating an exemplary interaction between a controller and the printing system from FIGS. 1 and 2.

In an exemplary embodiment, a controller 53 is provided (FIG. 3). The controller 53 can include processor circuitry that is configured to calculate the areal coverage of the recording medium with color. In an exemplary embodiment, the areal coverage is calculated for each side. Within the scope of the disclosure, other surface regions (for example every sheet that comprises multiple sides, or multiple specific sides, or multiple sheets) may also be used to calculate the areal coverage. The surface region may also be defined as an area of the recording medium that travels in a predefined time interval of for example, 1 s to 2 s.

Based on the transport velocity and the transport path from the print groups to the heating chamber 31, it can be determined when (the point in time) each side of the recording medium is supplied to the heating chamber 31 and the corresponding areal coverage of the sides of the recording medium. The areal coverage is proportional to the supplied quantity of flammable carrier fluid. In digital printing, the areal coverage may vary from side to side. In an exemplary embodiment, the controller can determine the quantity of carrier fluid that is supplied to the heating chamber 31 using the areal coverage. In an exemplary embodiment, this "prediction" of the quantity of carrier fluid is determined chronologically it before the carrier fluid is supplied to the heating chamber 31, so that the heating blower 37 may be activated at the correct time. In an exemplary embodiment, the heating blower 37 has a specific reaction time between the receipt of a control signal 54 that controls the quantity of the air flow and the actual adjustment of the air flow to the desired quantity. This reaction time (e.g., delay) is known and lies in a range from, for example, 0.5 s to 5 s. The air flow generated by the heating blower 37 is approximately proportional to the introduced quantity of carrier fluid, such that the proportion of the carrier fluid vapor in the combustible gas is approximately constant. In an exemplary embodiment, the control signal that controls the air quantity is supplied by the controller 53 to the heating blower 37 with in advance of the necessary reaction time so that the supplied air quantity adjusts synchronously with the supplied quantity of carrier fluid. That is, the controller 53 can be configured to control the air quantity to compensate for the delay of the activation of the heating blower 37 in response to the control signal 54.

In an exemplary embodiment, the control signal 54 regarding the air quantity (which is proportional to the supplied quantity of carrier fluid) is smoothed since the supplied quantity of carrier fluid may vary erratically.

In an exemplary embodiment, the supplied air quantity is approximately proportional to the supplied quantity of carrier fluid. In an exemplary embodiment, the quantity of fuel supplied directly to the burner 47 may also be taken into account as well in the determination of the air quantity, such that the air quantity is increased corresponding to the supplied fuel quantity. It may also be appropriate to vary the air quantity due to the recirculation of the exhaust air into the heating chamber.

In an exemplary embodiment, a prediction about the supplied quantity of carrier fluid is made so that the blower may be activated at the correct time. The supplied quantity of carrier fluid is the primary parameter for determining the supplied air quantity, but not the only one.

Printing with liquid toner at high efficiency is possible with this method. The liquid toner comprises the carrier fluid and toner particles. In an exemplary embodiment, the toner particles have a size of not more than 8 μm.

With this method it is avoided that a bypass is provided for the exhaust air to the heat exchanger. Such a bypass line is disadvantageous since: it is firstly very complicated and expensive due to the high waste gas temperatures; secondly is controlled by means of a flap that generates strong flow pulses that affect the entire flow mechanics in the cleaning system and the heating chamber; and additionally the chimney must be designed for correspondingly hot waste gases, which requires the use of very expensive materials. In addition to this, with the method according to the disclosure the addition of fuel may be kept very slight since the proportion of vaporized carrier fluid in the combustible gas always remains approximately the same.

The exemplary embodiments explained above have a liquid toner printing apparatus for printing to a recording medium with liquid toner. Within the scope of the disclosure it is also possible that the printing apparatus is designed as an inkjet printing apparatus, wherein then the print group has one or more inkjet print heads for printing to the recording medium with ink.

In the exemplary embodiments explained above, the combustible gas is subjected to a thermal combustion. Within the scope of the disclosure it is also possible to prepare the combustible gas by means of a catalytic afterburning.

The heat exchanger used in the exemplary embodiments explained above is operated in a reverse current. However, a heat exchanger may also be provided that is operated in parallel flow or cross flow.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, processor circuitry can include one or more circuits, one or more processors, logic, or a combination thereof. For example, a circuit can include an analog circuit, a digital circuit, state machine logic, other structural electronic hardware, or a combination thereof. A processor can include a microprocessor, a digital signal processor (DSP), or other hardware processor. In one or more exemplary embodiments, the processor can include a memory, and the processor can be "hard-coded" with instructions to perform corresponding function(s) according to embodiments described herein. In these examples, the hard-coded instructions can be stored on the memory. Alternatively or additionally, the processor can access an internal and/or external memory to retrieve instructions stored in the internal and/or external memory, which when executed by the processor, perform the corresponding function(s) associated with the processor, and/or one or more functions and/or operations related to the operation of a component having the processor included therein.

In one or more of the exemplary embodiments described herein, the memory can be any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

10 digital printer
11, 11*a*-11*d* print group (front side)
12, 12*a*-12*d* print group (back side)
20 recording medium
21 roll (input)
22 take-off
23 conditioning group
24 turner
25 register
26 puller
27 take-up
28 roll (output)
30 fixer
31 heating chamber
32 thermal cleaning system
33 belt cooling system
34 slot-shaped inlet
35 slot-shaped outlet
36 transport direction
37 heating blower
38 fresh air inlet
39 circulation inlet
40 air channel
41 air channel
42 nozzle
43 nozzle
44 escape line
45 escape blower
46 heat exchanger
47 burner
48 combustion chamber
49 exhaust air channel
50 chimney
51 opening
52 roll
53 controller
54 control signal
55 quantity of carrier fluid
60 climate control module
61 power supply
70 fluid management
71 fluid controller
72 reservoir

What is claimed is:

1. A method for digital printing to a recording medium with liquid print ink that includes a carrier fluid having pigment, a print image defined by print data being printed onto the recording medium via application of the liquid print color, after the application of the liquid print color onto the recording medium said recording medium is heated to vaporize the carrier fluid, upon heating, air is supplied that mixes with the vapor to form a combustible gas that is supplied to a combustion chamber and converted into waste gas, the method comprising:

determining an areal coverage that describes a quantity of color applied onto the recording medium by the carrier fluid; and controlling the air supply proportionally to the determined areal coverage.

2. The method according to claim 1, wherein the combustible gas is heated with at least a portion of the waste gas, and the waste gas is cooled using a heat exchanger.

3. The method according to claim 2, wherein a portion of the waste gas is used for heating the recording medium.

4. The method according to claim 1, wherein a portion of the waste gas is used for heating the recording medium.

5. The method according to claim 1, further comprising: adding fuel as needed during combustion.

6. The method according to claim 5, further comprising: controlling a quantity of the added fuel such that the combustion temperature is at least a predetermined minimum temperature, wherein the predetermined minimum temperature is determined by the chemical composition of the combustible gas and the fuel to prepare the waste gas for discharge to an environment.

7. The method according to claim 6, further comprising: controlling the supplied quantity of the added fuel such that the combustion temperature is less than or equal to a predetermined maximum temperature that is determined by the maximum thermal load of one or more devices that are hereby used in performing the method.

8. The method according to claim 1, wherein the liquid print color comprises at least one of:

a liquid toner including mineral oil; and an ink including a flammable solvent.

9. A non-transitory computer-readable storage medium having an executable program stored thereon, when executed, causes a processor to perform the method of claim 1.

10. A device for digital printing to a recording medium with liquid print color that includes a carrier fluid having pigment, with which a print image defined by print data is printed onto the recording medium, the device comprising:

a fixer including:

a heating chamber configured to heat the recording medium to vaporize the carrier fluid after application of the liquid print color onto said recording medium;

a blower configured to supply air into the heating chamber, the air mixing with the vapor to form a combustible gas; and a combustion chamber configured to burn the combustible gas to form waste gas; and a controller configured to:

determine an areal coverage that describes a quantity of color applied onto the recording medium using the carrier fluid; and control the air supplied to the heating chamber proportionally to the determined areal coverage.

11. The device according to claim 10, further comprising: a heat exchanger configured to heat the combustible gas and cool the waste gas to be discharged to an environment.

12. The device according to claim 11, further comprising: a waste gas return feed configured to return the waste gas from the combustible gas to the heating chamber.

13. The device according to claim 10, further comprising: a waste gas return feed configured to return the waste gas from the combustible gas to the heating chamber.

14. The device according to claim 10, further comprising: one or more print groups configured to apply the carrier fluid onto the recording medium.

15. A device for digital printing to a recording medium with liquid print color that includes a carrier fluid, the device comprising:

a fixer including:

a heating chamber configured to heat the recording medium to vaporize the carrier fluid after application of the liquid print color onto said recording medium; and a blower configured to supply air into the heating chamber; and a controller configured to:

determine an areal coverage corresponding to a quantity of color applied onto the recording medium; and control the air supplied to the heating chamber based on the determined areal coverage.

16. The device according to claim 15, wherein controlling the air supplied to the heating chamber comprises compensating for activation delays of the blower.

* * * * *